US008596857B2

(12) United States Patent
Bastesen

(10) Patent No.: US 8,596,857 B2
(45) Date of Patent: Dec. 3, 2013

(54) MEANS AND METHOD FOR MIXING A PARTICULATE MATERIAL AND A LIQUID

(75) Inventor: Yngve Bastesen, Lier (NO)

(73) Assignee: National Oilwell Norway AS, Asker (NO)

( * ) Notice: Subject to any disclaimer, the term of this patent is extended or adjusted under 35 U.S.C. 154(b) by 806 days.

(21) Appl. No.: 12/733,104

(22) PCT Filed: Oct. 9, 2008

(86) PCT No.: PCT/NO2008/000357
§ 371 (c)(1),
(2), (4) Date: Feb. 24, 2010

(87) PCT Pub. No.: WO2009/048337
PCT Pub. Date: Apr. 16, 2009

(65) Prior Publication Data

US 2010/0157722 A1 Jun. 24, 2010

(30) Foreign Application Priority Data

Oct. 12, 2007 (NO) ..... 20075253

(51) Int. Cl.
*B01F 5/02* (2006.01)

(52) U.S. Cl.
USPC ..... 366/136; 366/162.4

(58) Field of Classification Search
USPC ..... 366/136, 137, 162.4, 173.2, 178.2
See application file for complete search history.

(56) References Cited

U.S. PATENT DOCUMENTS

| | | | | |
|---|---|---|---|---|
| 3,424,386 | A * | 1/1969 | Maasberg et al. | 239/427.3 |
| 3,833,718 | A * | 9/1974 | Reed et al. | 423/629 |
| 3,972,150 | A | 8/1976 | Hart | |
| 4,125,969 | A | 11/1978 | Easton | |
| 4,125,989 | A | 11/1978 | Stahlecker et al. | |
| 4,186,772 | A * | 2/1980 | Handleman | 137/891 |
| 4,478,368 | A | 10/1984 | Yie | |
| 4,765,540 | A | 8/1988 | Yie | |
| 2003/0043689 | A1 * | 3/2003 | Jang et al. | 366/165.2 |
| 2006/0109738 | A1 * | 5/2006 | Buchholz | 366/162.4 |
| 2007/0003497 | A1 | 1/2007 | Holloway, Jr. et al. | |
| 2009/0190434 | A1 * | 7/2009 | Allen | 366/132 |

FOREIGN PATENT DOCUMENTS

| | | |
|---|---|---|
| GB | 543995 | 3/1942 |
| WO | WO 98/08596 | 3/1998 |
| WO | WO 2007/096383 A1 | 8/2007 |

* cited by examiner

*Primary Examiner* — David Sorkin
(74) *Attorney, Agent, or Firm* — Cozen O'Connor

(57) ABSTRACT

A means for securing a proper mixing of a particle shaped material, such as powder, into a liquid by supplying shear forces in a mixing zone, the shear forces being produced by pumping liquid through a restriction (22), such as a nozzle (27,29) in a pipe at a high pressure. A plurality of nozzles (22) is used, placed in such position with respect to each other that a jet from at least one of the nozzles (22) hits the jet from at least a second nozzle (22) in one single theoretical point downstream of the nozzles (22).

9 Claims, 3 Drawing Sheets

MEANS AND METHOD FOR MIXING A PARTICULATE MATERIAL AND A LIQUID

PRIORITY CLAIM

This is a U.S. national stage of application No. PCT/NO2008/000357, filed on 9 Oct. 2008, and priority is claimed from Norwegian Application No. 20075233, filed 12 Oct. 2007, the contents of both of which are incorporated herein by reference.

TECHNICAL FIELD

The present invention relates to a unit for securing proper mixing of a particulate material, such as powder, into a liquid by exposing the mixture to shear forces in a mixing zone, wherein the shear forces are formed by pumping the fluid through a contraction, such as a nozzle, in a pipe at high pressure.

BACKGROUND FOR THE INVENTION

When producing liquids, such as for example drilling fluid, large volumes of fine graded material, such as powder, and a suitable liquid are mixed. The mixing of fine graded material into a liquid requires large shear forces in order to obtain the required quality of mixture.

U.S. Pat. No. 4,765,540 discloses a process and an apparatus for generating a plurality of helically shaped converging or diverging fluid flows, and where a particle shaped material is added to said flow, downstream of the nozzles, said particles being introduced into the fluid flow in such way that the particles are distributed over a large area. The purpose of the solution according to U.S. Pat. No. 4,765,540 is to use the fluid containing particles as an abrasive medium to abrade or cut through a material, such as very hard materials such as concrete, rock, glass or metal.

SUMMARY OF THE INVENTION

An object of the present invention is to provide an improved solution, continuously securing a more or less continuous homogeneous liquid, formed by mixing two or more components, such as one or more solid substances and one or more liquids, or mixing a plurality of liquids or fluids.

Another object of the solution according to the invention is provide a robust solution, producing such improved mixtures and reducing the wear on the equipment, while the solution by simple means is easy to maintain by replacement of elements exposed to wear.

A still further object of the invention is to provide a solution producing so large mixing energy that a uniform mixture of two ingredients is obtained.

The objects of the present invention are achieved by a solution as further defined in the independent claims.

Various embodiments of the invention are defined by the dependent claims.

A characteristic feature of the invention is that a plurality of nozzles are used, said nozzles being configured in such manner with respect to each other, that a jet from at least one nozzle hits the jet from at least a second nozzle in one single theoretical point downstream of the nozzles.

In order to wash, add and mix homogeneous powder particles into a liquid, a high pressure liquid jet with high velocity is used, so that a homogeneous liquid is formed when the liquid jets hit each other in said single point. When mixing liquids and powder mixtures which are not completely mixed to a homogeneous mixture, i.e. that not all the powder are completely and evenly mixed into the liquid, a high pressure nozzle means will introduce so large extra shear forces onto the liquid and the powder, that an extra rapid mixing process will be obtained. To add sufficiently large shear forces via the nozzles will expose the not yet homogeneous mixture sufficiently large forces to obtain a uniform mixture.

According to another embodiment two nozzles having center axis forming an angle with each other and meeting in a single meeting point, is used. Both nozzles may possibly be inclined with respect to the general direction of flow through the section of the pipe. Alternatively, only one nozzle may be inclined, while the other nozzle has a center axis which is parallel with said general direction of flow.

According to yet another embodiment the nozzles may be arranged in the same cross section plane of the pipe. An alternative embodiment may be that the nozzles are arranged at different levels with respect to direction of flow.

The angle between the center axis of the nozzles may preferably be in the range 10-45 degrees, preferably 10-20 degrees.

The nozzles may be configured in such manner with respect to each other that a strong turbulence is created downstream of the nozzles.

According to the invention, a solution which is robust and giving an improved mixing of different substances/fluids, is provided. Since the not-homogeneous mixture is choked strongly upstream of the nozzles and since the forceful jets formed by the nozzles meet in a single point downstream of the nozzles, large extra shear forces are imposed, so that the powder material is forced into the liquid, thus forming a homogeneous mixture.

Further, the solution makes it possible for separate supply of different substances/fluids through different nozzles.

The nozzles may preferably be replaceable units which may be oriented in such way that the jets meet in a point downstream of the nozzles and in such way impose increased shear forces into the liquid.

SHORT DESCRIPTION OF THE DRAWINGS

A preferred embodiment of the present invention shall in the following be described in more details, referring to the accompanying drawings, where:

DETAILED DESCRIPTION OF AN EMBODIMENT OF THE INVENTION

Figure 1:
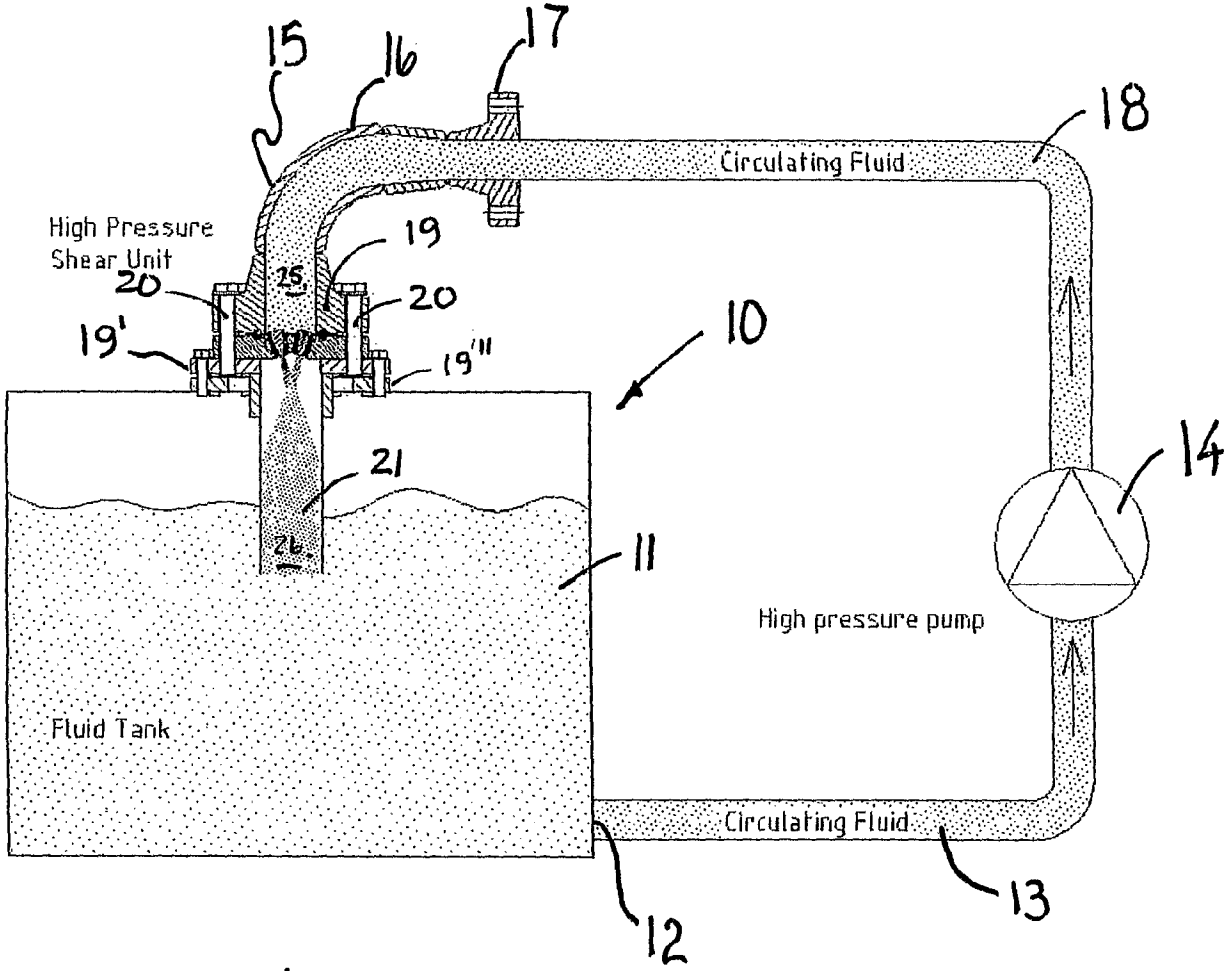
FIG. 1 shows schematically a vertical view seen in section through a system comprising shear nozzles according to the present invention.

FIG. 1 shows schematically a sectional view of a plant for producing drill mud or drill liquid, where a powder formed material is mixed with a liquid. The plant 10 comprises a tank or a container 11 containing a liquid, such as drill liquid. At the bottom of the tank 11 an outlet 12 is arranged, through which the liquid in the tank 11 is pumped out by means of a high pressure pump 14 through a pipe 13. From the pump 14, the liquid is circulated back to the tank 11 through a unit 15 where the liquid is subjected to large kinetic energy. From this unit 15 the liquid is fed back to the tank 11. Further, the plant 10 is provided a supply pipe (not shown) for supplying powder and liquid, and a pipe (not shown) for exporting the completely mixed drill liquid to the place of application, such as for example a well. It should be appreciated, however, that the fluid to be exposed to shear forces also may be pumped from a second tank to the tank containing the shear unit.

As indicated in FIG. 1, the pipe 21 downstream of the nozzle unit may preferably extend so far down into the tank or the container 11 that the lower end of the pipe 21 will be completely submerged into the liquid. In such way unnecessary wear of the material in the tank bottom is avoided. In addition, the increased cross sectional area of the boring 26 will contribute to reduction of the pressure and the flow velocity.

Figure 2:
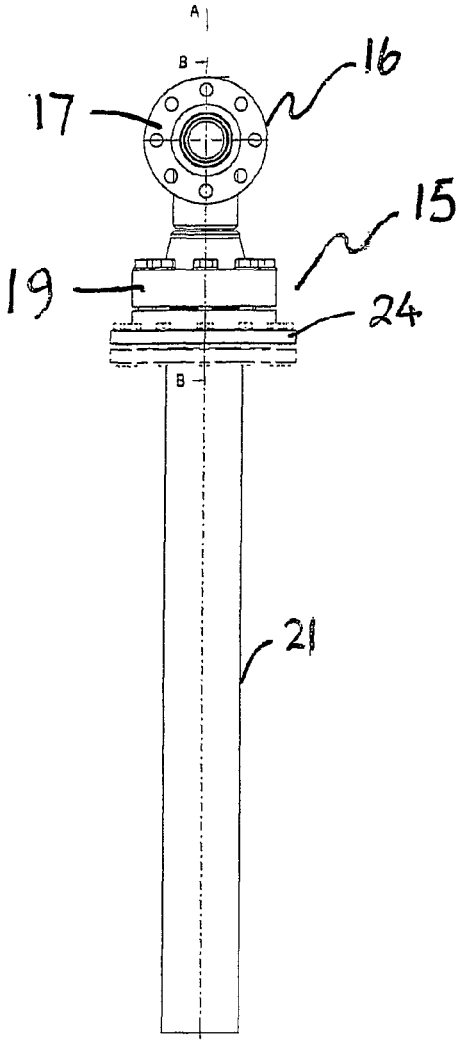
FIG. 2 shows a vertical section seen from the front of a pipe unit provided with nozzles according to the present invention.

FIG. 2 shows a vertical view of the mixing unit 15. Said unit comprises a pipe bend 15 which at one end is provided with a flange 17 for replaceable connection to a pipe 18 from the high pressure pump 14. At the first part of the pipe bend 16, the pipe diameter is increased. Said change in pipe diameter is primarily that in this part of the unit, it is a desire to increase the diameter in order to reduce the flow velocity through the pipe and correspondingly also wear on the pipe walls. A second purpose is to enable the pipe to fit into other existing units, said change being achieved by applying a transition piece. Often, the present equipment is installed in already existing plants where the pipes may have smaller diameters, while it still is desired to maintain a certain diameter in the pipe in order to minimize the wear and obtain an effective mixing. The bend 16 may have a 90° bend. At the opposite end, the bend 16 is provided with a second flange 19, which for example by means of bolts 23, is designed to be exchangably attached to the pipe 21. At this end of the pipe 16, in connecting with the flange 19, a unit is exchangably arranged, said unit comprises nozzles 22 according to the present invention. The nozzles 22 are mounted in an otherwise tight plate 23 which is in a sealed manner rests against the flange 10 in the pipe and against a corresponding flange 24 on the pipe 21. The attachment and the functioning of the nozzles will be described in further detail below, referring to the FIGS. 3 and 4. Also this flange joint may be based on use of bolts 20.

Figure 3:
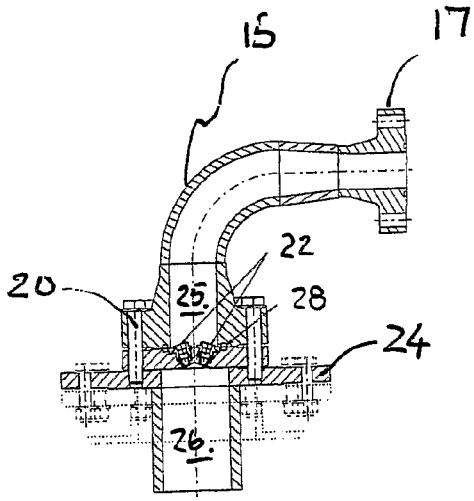
FIG. 3 shows a vertical section through the house in which the nozzles are arranged, seen along the line B-B in FIG. 2.
Figure 4:
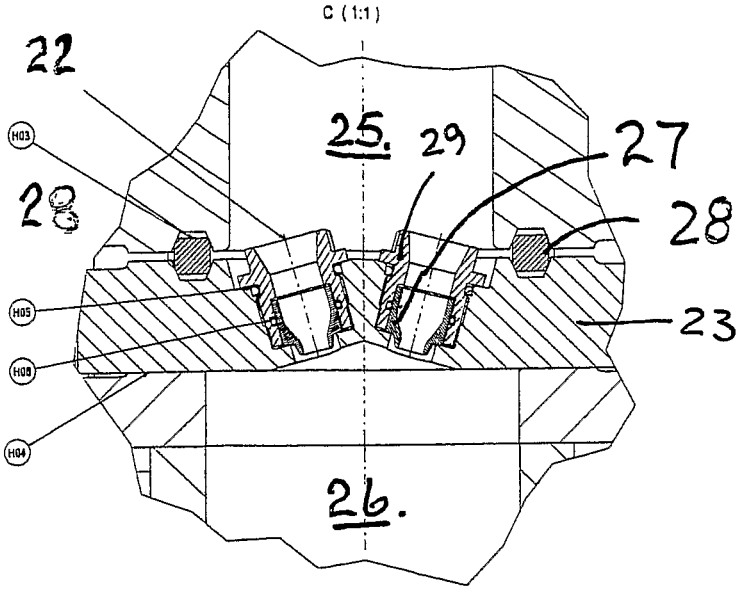
FIG. 4 shows an enlarged view of a vertical section through the part of the pipe where the nozzles according to the present invention are arranged.

As indicate in FIGS. 3 and 4 the bore 26 of the pipe 21 has a larger diameter than the bore 25 of the bend 16. The pressure here is a quite different pressure, the pressure being more or less identical with the atmospheric pressure. With the volume of liquid to be pressed down into the tank filled with liquid, it is advantageous with a larger diameter, also reducing the velocity of flow and hence reduces wear and tear on the pipe wall.

The nozzles 22 are attached to the plate 22 in a manner well known to the person skilled in the art, and consequently will not be described in further detail. The plate 22 may for this purpose be provided with bores into which the nozzles 22 are fitted. The nozzles 22 comprise a holding means 29 and a loosely mounted nozzle body 27. The holding means is at its lower external surface provided with threads in order to enable screwing into a correspondingly threaded hole in the plate 23, since the nozzle body 27 is considered to be a part which is strongly exposed to wear and hence, more or less frequent must be replaced, or must be adaptable to another liquid or liquid mixture to be mixed. As shown in the FIGS. 3 and 4, two nozzles 22 according to the present invention are used, the nozzles 22 being arranged in the same cross section. The nozzles are inclined so that an axis through the nozzles forms an angle with the center line of the pipe 21. Said angle may preferably be in the range 10-50°, preferably 10-20° with said center axis. The nozzles 22 have a larger cross sectional area at the inlet than the area at the outlet, whereby the pressure in the fluid increases when flowing through the nozzles 22. Further, the nozzles 22 are symmetrically arranged with respect to the centerline of the pipes 25,26.

The plate is at least on its upper surface provided with ring shaped recesses, intended for receiving seals 26. Due to the high pressure this part of the unit 11 is exposed to, the material in the bend 16 has a larger thickness. In addition, both the bend 16 and the plate 23, including the nozzles 22, are exchangably mounted. Additionally, the nozzles 22 are exchangably attached to the plate 23.

The pressure of the liquid will increase further and thus inducing the required shear forces on the mixture when the liquid containing the particles of the powder is pumped at a high pressure through the bend 23, meeting the plate 23 with the nozzles where the opening area is substantially smaller than the opening 25 of the pipe bend 16. This effect is increased due to the fact that the flow addition is choked due to the reduction in cross sectional area of the nozzle openings. The large shear forces in the liquid will consequently contribute to an improved mixing of the particles of the powder into the liquid.

The pressure imposed onto the liquid will be up to 10,000 psi. The pump used may for example be a high pressure pump, but it is also possible to use pumps creating a lower pressure, such as for example centrifugal pumps, without deviating from the inventive idea.

According to an alternative of the solution according to the invention, each of the nozzles 22 may be connected to a separate supply pipe, so that different types of substances or compounds and/or fluid may be supplied through the different nozzles. Thus, the mixing occur downstream of the nozzles 22 introducing large shear forces into the mixed compound.

At the bottom of the tank 11 a wear preventing plate may be arranged in the vicinity of the exit of the pipe 21, so that the tank bottom is not subjected to wear as a consequence of the fluid flow.

The invention claimed is:

1. An apparatus for securing a proper mixing of a particulate material into a liquid, comprising:

a storage tank containing mixture of liquid and a particulate material;

a pump for circulating the mixture of liquid and particulate material;

a plurality of nozzles each having a smaller cross sectional area at its outlet than at its inlet, the mixture of liquid being pumped through the plurality of nozzles and producing liquid jets meeting each other;

pipelines associated with the pump and transporting said mixture of liquid from the storage tank through the plurality of nozzles and back to the storage tank; and a further pipe arranged downstream of the plurality of nozzles and extending down into the storage tank such that a lower end of the further pipe is completely submerged into said mixture of liquid;

wherein the plurality of nozzles are arranged in a pipe of the associated pipelines downstream of an outlet from the storage tank, each nozzle of the plurality of nozzles having a center axis which converges towards another center axis of another nozzle of the plurality of nozzles, so that the liquid jets of the mixture of liquid meet in one single theoretical point downstream of the plurality of nozzles.

2. The apparatus according to claim 1, wherein one nozzle of the plurality of nozzles is inclined with respect to a general direction of flow through the pipes associated with the pump, while a center line of another nozzle of the plurality of nozzles is parallel with a center axis of the pipes associated with the pump.

3. The apparatus according to claim 1, wherein each nozzle of the plurality of nozzles are arranged in the same cross sectional plane in the pipe.

4. The apparatus according to claim 1, wherein an angle between the center axis of the plurality of nozzles is in a region of 10-45 degrees.

5. The apparatus according to claim 1, wherein each of the plurality of nozzles is configured to create strong turbulences downstream of the plurality of nozzles.

6. The apparatus according to claim 1, wherein each of the plurality of nozzles is a replaceable unit oriented such that the liquid jets meet in the one single theoretical point downstream of the plurality of nozzles to impose increased shear forces into the liquid mixture.

7. The apparatus according to claim 1, wherein the plurality of nozzles are contained in a nozzle unit.

8. The apparatus according to claim 1, wherein a pressure increase in the liquid mixture when flowing through is created by each of the plurality of nozzles having the larger cross sectional area at its inlet than the area at its outlet.

9. The apparatus of claim 1, wherein the plurality of nozzles are symmetrically arranged with respect to a center-line of the pipe.

* * * * *